United States Patent [19]

Shook et al.

[11] Patent Number: 4,826,397

[45] Date of Patent: May 2, 1989

[54] STATOR ASSEMBLY FOR A GAS TURBINE ENGINE

[75] Inventors: Paul S. Shook, Marlborough; Daniel E. Kane, Tolland, both of Conn.

[73] Assignee: United Technologies Corporation, Hartford, Conn.

[21] Appl. No.: 212,827

[22] Filed: Jun. 29, 1988

[51] Int. Cl.[4] ..... F04D 15/00; F04D 29/00

[52] U.S. Cl. ..... 415/116; 415/136; 415/175; 415/178; 60/39.75; 60/226.1

[58] Field of Search ..... 415/116, 136, 175, 178; 60/39.75, 226.1, 262, 39.07

[56] References Cited

U.S. PATENT DOCUMENTS

| | | | |
|---|---|---|---|
| 4,019,320 | 4/1977 | Redlinger, Jr. et al. | 415/116 |
| 4,069,662 | 1/1978 | Redinger, Jr. et al. | 415/116 |
| 4,268,221 | 5/1981 | Monsarrat et al. | 415/116 |
| 4,337,016 | 7/1982 | Chaplin | 415/116 |
| 4,485,620 | 12/1984 | Koenig et al. | 415/136 |
| 4,527,385 | 7/1985 | Jumelle et al. | 415/116 |
| 4,553,901 | 11/1985 | Laurello | 415/139 |
| 4,642,024 | 2/1987 | Weidner | 415/116 |
| 4,643,638 | 2/1987 | Laurello | 415/136 |
| 4,679,981 | 7/1987 | Guibert et al. | 415/116 |
| 4,752,184 | 7/1988 | Liang | 415/116 |

FOREIGN PATENT DOCUMENTS

| | | | |
|---|---|---|---|
| 2534982 | 10/1982 | France | 415/175 |
| 2062763A | 5/1981 | United Kingdom | 60/226.1 |
| 2169356A | 12/1985 | United Kingdom | 415/175 |

*Primary Examiner*—Robert E. Garrett
*Assistant Examiner*—Michael V. Readby

[57] ABSTRACT

A coolable stator assembly is positioned outwardly of an array of rotor blades in a high by pass turbofan gas turbine engine as disclosed. The stator assembly includes case tied air seals positioned by rails and a shield which extends circumferentially about the rails and the rail connector section extending between the rails. Various constructions details for improving the control of clearances and circumferential temperature gradients in the rails are developed. In one particular embodiment, cooling air tubes are employed with the shield.

18 Claims, 4 Drawing Sheets

STATOR ASSEMBLY FOR A GAS TURBINE ENGINE

TECHNICAL FIELD

This invention relates to axial flow gas turbine engines and more particularly to a stator structure which includes an outer case and an array of outer air seals attached to the outer case. In such constructions, the outer air seals are supported and positioned by the outer cafe about a rotor assembly. The concepts of the present invention were developed in the field axial flow gas turbine engines and have application to stator structures in other fields.

BACKGROUND OF THE INVENTION

One example of a power plant employing an axial flow rotary machine is a turbofan gas turbine engine for powering an aircraft and the engine's associated nacelle. The nacelle shelters the engine and accessory equipment, and provides aerodynamic surfaces which cooperate with the engine for generating thrust.

A primary flow path for working medium gases extends through the central or core region of the turbofan engine. A secondary flow path for working medium gases is disposed outwardly of the primary flow path and is annular in shape. The engine has a plurality of fan blades which extend radially outwardly across the primary flow path and secondary flow path. These fan blades pressurize working medium gases entering both flow paths of the engine. The ratio of mass flow through the secondary flow path to the mass flow through the primary flow path is the by-pass ratio of the engine. By-pass ratios greater than 3.5 are referred to as high by-pass ratio turbofans.

The nacelle of high by-pass ratio turbofans includes a fan nacelle and a core nacelle which are of relatively large diameter. These nacelles are often referred to as the fan cowling and the core cowling. The core nacelle is spaced from the engine leaving a core compartment therebetween which extends about the gas turbine engine. As a result of heat transfer from the gas turbine engine and many accessories disposed in the compartment, the temperature of gases in the core compartment may exceed one-hundred and fifty degrees Fahrenheit.

The core nacelle is disposed radially inwardly of the fan nacelle leaving a region therebetween for the secondary flow path. An exterior wall of the core nacelle and an interior wall of the fan nacelle bound the secondary flow path. Thus, as these gases are flowed through the engine, the gases flow over the walls of the nacelles and the walls are contoured to minimize the drag effect that these walls have on the high velocity gases in the secondary flow path.

The turbofan engine includes a compression section, a combustion section and a turbine section. The primary flow path extends axially through these sections of the engine. The working medium gases are drawn into the compression section where they pass through several stages of compression, causing the temperature and pressure of the gases to rise. The gases are mixed with fuel in the combustion section and burned to form hot pressurized gases. These gases are a source of energy to the engine and are expanded through the turbine section to produce work.

The engine has a rotor assembly for transferring the work of compression from the turbine section to the compression section. A stator assembly extends circumferentially about the rotor assembly to circumscribe the rotor assembly and axially through the engine. The stator assembly includes an outer case or pressure vessel which confines the high pressure working medium gases to the primary flow path.

The rotor assembly includes rows of rotor blades which extend outwardly across the working medium flow path. The stator assembly includes a row of stator vanes which extends radially inwardly across the working medium flow path upstream of each row of rotor blades to direct the working medium gases at the proper angle into the rotor blades.

The stator assembly includes sealing elements for blocking the leakage of working medium gases from the working medium flow path. The sealing elements in modern engines include outer air seals formed of arcuate segments which extend circumferentially about the interior of the engine. The sealing elements are spaced radially from the rotor blades by a clearance gap G. It is important to avoid predictable local discontinuities in the circumferential shape of the outer air seal to insure the predetermined clearance gap is minimized. It is also important to minimize unpredictable discontinuities in the circumferential shape of the outer air seal to avoid destructive interference between the rotor blade tips and the outer air seal, which can degrade the sealing ability of the outer air seals.

Modern high bypass turbofan engines employ clearance control systems to change the diameter of the outer air seal to minimize the clearance gap at steady state operating conditions while accommodating transient differences in growth between the diameter of the outer air seal and the diameter of the row of rotor blades. U.S. Pat. No. 3,966,354 and U.K. Pat. No. GB2025536 are exemplary of structures using cooling air or heating air on the interior of the outer case (that is, inside the pressure vessel) to control the diameter of the outer air seal and, thus, the clearance gap between the outer air seal and the rotor blades of the rotor assembly.

More particularly, U.S. Pat. No. 3,966,354 issued to Patterson entitled "Thermal Actuated Valve for Clearance Control" shows an outer case which forms the pressure vessel for the engine and an inner case spaced radially inwardly from the outer case. The outer air seal is attached to the inner case. A chamber is disposed between the inner case and the outer case and receives cooling air from a compression section of the engine. The cooling air is flowed through the chamber and through flanges on the inner case to control the clearance between the rotor assembly and the outer air seal. As will be appreciated, the cooling air must be at a high pressure because the cooling air is exhausted inside the pressure vessel, such as into the working medium flow path. A significant amount of work must be done on the gases to compress the gases to a pressure which will permit the gases to flow into the working medium flow path. And, compressing the gases to the high pressure causes the temperature of the gases to rise decreasing the effectiveness of the cooling air as a cooling medium.

U.K. Pat. No. GB 2,025,536 issued to Davison entitled "Turbine Rotor-Shroud Clearance Control System" is another example of an internal clearance control system. Davison shows an outer case, a shroud support inwardly of the outer case and an outer air seal attached to the shroud support. An impingement ring extends circumferentially about the shroud support to impinge cooling air on the shroud support to adjust the clearance gap between the outer air seal and the rotor blade. Cooling air is flowed at high pressure from the chamber between the impingement ring and the inner case through a flange joint to a downstream location. As in the Patterson patent the cooling air is discharged inwardly of the pressure vessel of the gas turbine engine into the working medium flow path.

In other modern engines, the clearance gap between the rotor blades and the outer air seal is adjusted by attaching the outer air seal to the pressure vessel, such as a coolable outer case, and impinging cooling air on the exterior of the case. Examples of engines employing the coolable outer case to adjust the clearance between rotor blades and the outer air seal are shown in U.S. Pat. No. 4,019,320 issued to Redinger et al entitled "External Gas Turbine Engine Cooling for Clearance Control"; U.S. Pat. No. 4,247,248 issued to Chaplin et al entitled "Outer Air Seal Support Structure for a Gas Turbine Engine"; U.S. Pat. No. 4,485,620 issued to Koenig et al entitled "Stator Assembly for a Gas Turbine Engine"; and, U.S. Pat. No. 4,533,901, issued to Laurello entitled "Stator Structure for a Gas Turbine Engine". As shown in these patents, the outer case is attached to the outer air seals so that selective cooling of the outer case changes the diameter of the outer case and causes a similar change in the diameter of the seals. Thus, as the diameter of the outer case decreases, the outer air seal diameter decreases and the clearance gap becomes smaller.

In each of these patents, the outer air seal is attached to the outer case either at one location (Laurello) or at two locations (Redinger, Chaplin, and Koenig). The outer case includes a coolable rail which extends circumferentially about the exterior of the outer case and extends outwardly into a nacelle compartment. The rails stiffen the case and increase the force exerted by the outer case for a given change in temperature of the rails. The rails may be flanges which are bolted together or an integral rail which extends as one piece about the exterior of the outer case.

Arrays of cooling tubes extends circumferentially about the engine and are in flow communication with the compression section of the engine, such as the fan section of the engine, to provide cooling air at a pressure which is relatively low in comparison to the cooling air used in internal clearance control systems. The cooling air has the advantage of being cooler by reason of the amount of pressurization because the pressure in the nacelle compartment is much less than the pressure on the interior of the engine.

Because the cooling air that is impinged on the rails is removed from the working medium flow path after energy is expended by the engine to pressurize the gases, it is desirable to reduce the amount of cooling air needed for clearance control. In addition, it is desirable to operate the engine with smaller clearances between the rotor blades and the outer air seal to minimize the amount of cooling air needed to move the outer case from its maximum diameter to its minimum diameter.

Accordingly, scientist and engineers working under the direction of applicant's assignee have sought to develop constructions which would require less cooling air for a given amount of clearance control to increase the efficiency of the engine while maintaining an adequate fatigue life in components of the engine.

DISCLOSURE OF THE INVENTION

This invention is in part predicated on the recognition that severe temperature gradients occur in the gases within the nacelle compartment of high bypass ratio turbofans because of accessories to the engine which may cool or heat air and because of fan bypass air which leaks into the nacelle causing localized cool regions. Moreover, the gases in the nacelle compartment are heated because of the presence of the engine in the nacelle compartment. The localized hot regions and cool regions cause circumferential temperature gradients in rails on the outer case which adversely affect the concentricity of the outer case. And, radial and circumferential temperature gradients increase stresses in the flanges which require larger flanges to accommodate the stresses with adequate fatigue life. Moreover, the hotter regions heat the cooling air prior to the cooling air impinging on the outer case which decreases the effectiveness of the cooling air.

According to the present invention, a high bypass turbofan gas turbine engine having outer air seals attached to an outer case and axially spaced rails for positioning the outer air seals, includes a shield spaced radially from the outer case leaving an annular chamber therebetween in flow communication with the nacelle compartment, the shield extending circumferentially about the outer case and axially over the rails and over the portion of the outer case extending between the rails to block heat transfer between the outer case and gases in the nacelle.

In accordance with the present invention, a clearance control system for such a gas turbine engine includes a device for impinging cooling air on the exterior of the engine at selected operating conditions to adjust internal operating clearances the clearance gap between rotor blades and an outer air seal and includes a shield extending circumferentially and axially about the engine for directing the flow of cooling air after impingement at the selected operating conditions and for shielding the exterior of the engine from gases on the interior of the nacelle at all operating conditions of the engine.

A primary feature of the present invention is a turbofan gas turbine engine which is disposed in a nacelle compartment. The engine has a pressure vessel or outer case exposed to the gases on the interior of the nacelle. Outer air seals are attached to the outer case. At least one rail is outward of each outer air seal for controlling the diameter of the outer air seal from the outer case. Another feature is a shield extending circumferentially and axially about the outer case which is spaced radially from the outer case leaving a chamber therebetween. The chamber is in flow communication with the nacelle compartment. In one embodiment, a device for impinging cooling air on the rails is located inwardly of the outermost portion of the shield. In one detailed embodiment, the shield is a cooling air manifold spaced radially from the engine having openings for impinging cooling air on the rails. The shield manifold extends over both rails and over the section of casing which connects the rails. Insulation is disposed on the interior of the manifold. Vent passages extend radially through the manifold for ducting cooling air away from the annular chamber after the cooling air has impinged on the outer case. The vent passages are located in the manifold so that cooling air flows over the rails and over the outer case. In another detailed embodiment of the shield, the shield is formed of a plurality of cooling air tubes which extend circumferentially about the outer case for impinging cooling air on the outer case. The shield has elements which extend axially between the cooling tubes to form a longitudinally continuous structure.

A primary advantage of the present invention is the engine efficiency which results from the concentricity of the outer case and the level of stresses which results from shielding the outer case from thermal gradients in the nacelle compartment. Over heating is avoided by venting the shielded annular chamber into the nacelle compartment. Shielding decreases the circumferential temperature gradient in the rail or flanges because the gases in the interior of the nacelle are relatively cool at times when the cooling air is off and relatively hot at times when the cooling air is on in comparison to the cooling air in the annular chamber. Another advantage of the present invention is the effectiveness of the cooling air which results (1) from decreasing heat transfer from gases in the nacelle compartment to the cooling air prior to impingement, (2) from more effectively using the cooling air by flowing the cooling air to other locations along the outer case where the cooling fluid performs convective cooling and (3) from increasing the temperature differences between the cooled outer case (cooling air on) and the uncooled outer case (cooling air off). The larger temperature difference results from the shield which creates an annular chamber within the nacelle compartment which operates at a higher temperature in comparison to the nacelle compartment when the cooling air is off and a lower temperature in comparison to the nacelle compartment when the cooling air is on.

The foregoing and other features and advantages of the present invention will become more apparent from the following description and accompanying drawings.

BEST MODE FOR CARRYING OUT THE INVENTION

Figure 1:
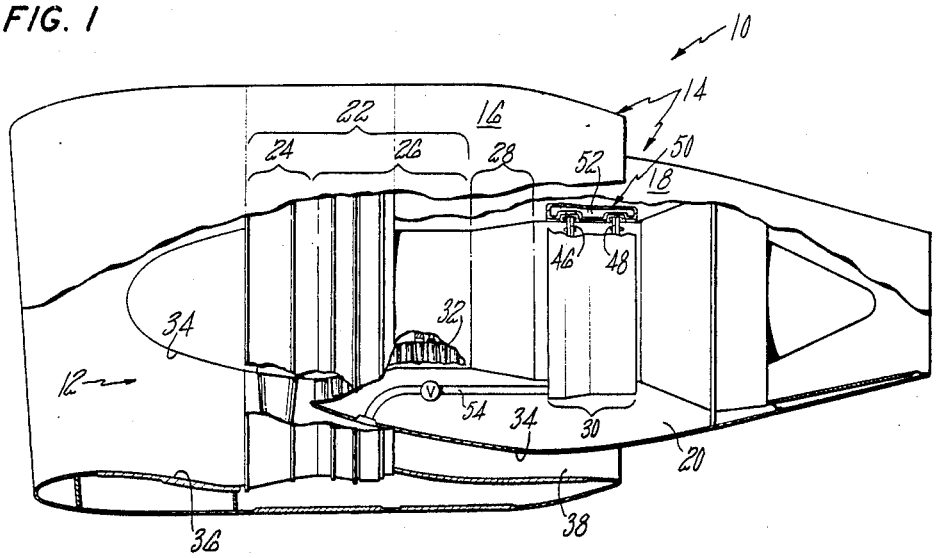
FIG. 1 is a side elevation view of a power plant for a gas turbine engine with a portion of the core nacelle broken away to show a high by pass turbofan engine.

A power plant 10 having a high bypass turbofan gas turbine engine for an aircraft is shown in FIG. 1. The structure of the power plant includes the turbofan 12 and a pylon (not shown) for supporting the engine from the aircraft. The power plant structure also includes a nacelle 14 which circumscribes the engine.

The nacelle 14 includes a fan nacelle 16 and a core nacelle 18. The core nacelle is spaced radially from the engine leaving a core compartment 20 therebetween. Accessory equipment (not shown) for the engine is disposed in the core compartment. Doors (not shown) on the nacelle provide access to the core department.

The turbofan engine 12 has a compression section 22 which includes a fan section 24 and a compressor section 26. A combustion section 28 and a turbine section 30 are axially rearward of the compression section. A primary flow path 32 for working medium working gases extends rearwardly through these sections of the engine.

The core compartment 20 has an outer wall 34 which extends circumferentially about the engine. The fan nacelle 16 has a wall 36 which is spaced radially outward from the outer wall 34 of the core compartment leaving a fan bypass flow path 38 (secondary flow path) therebetween. The secondary flow path extends rearwardly over the nacelle walls 34, 36, is annular, and is disposed outwardly of the primary flow path.

The ratio of secondary mass flow through the bypass duct to the primary mass flow along the primary flow path is approximately three and a half to one or greater which causes the turbofan engine to be classified as a high bypass turbofan engine. As can be seen from the FIG. 1, the front section of the engine has a much larger diameter than the rear section to accommodate the flow along the secondary flow path. A correspondingly large nacelle is required to circumscribe the engine.

The turbine section 30 of the engine has a stator assembly which includes a plurality of rails or flanges, as represented by the first rail 46 and the second rail 48. The rails extend circumferentially about the exterior of the engine. A shield 50 outwardly of the rails is disposed in the core compartment 20. The shield is spaced radially from the rails and extends axially and circumferentially about the turbine section 30. The shield has a cooling passage 52 for flowing cooling air about the exterior and for discharging the cooling air on the exterior of the engine. The cooling passage is in flow communication via a pipe or duct 54 with a source of cooling air such as the secondary flow path 38. A valve V is used to turn on and off the flow of cooling air to the cooling passage.

Figure 2:
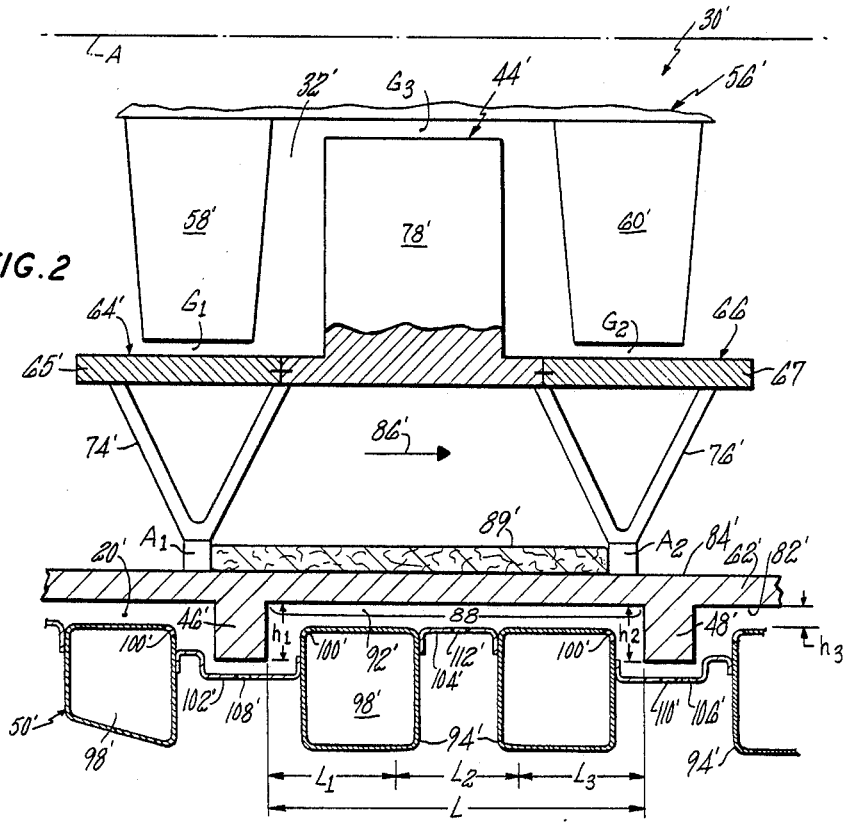
FIG. 2 is a schematic representation of a portion of the turbine section of such an engine showing an alternate embodiment of the shield which extends about the engine.
Figure 5:
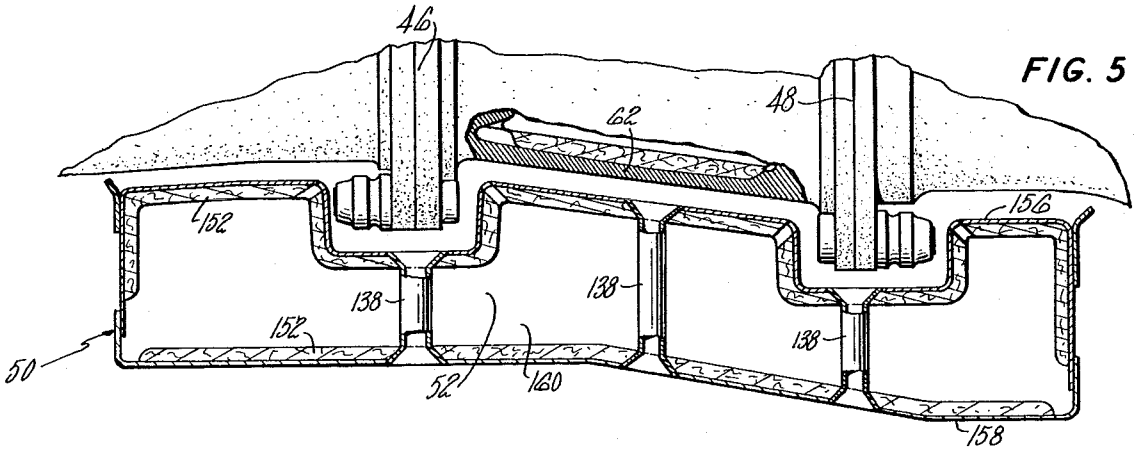
FIG. 5 is an alternate embodiment of the shield shown in FIG. 4.

FIG. 5 is a more detailed, perspective view of the shield assembly of FIG. 1. For ease of explanation, however, the invention will first be described with respect to FIG. 2, which is a simplified schematic representation of a shield assembly in accordance with one embodiment of the present invention. More specifically, FIG. 2 shows a portion of the turbine section 30' and adjacent structure of the engine similar to that of FIG. 1. The adjacent structure includes a rotor assembly 56' which extends axially through the engine and which is rotatable about an axis of rotation A. The rotor assembly includes a first row of rotor blades 58' and a second row of rotor blades 60'. Each row of rotor blades extends outwardly across the working medium flow path into proximity with the stator assembly 44'.

The stator assembly includes an outer case 62' and outer air seals as represented by the first outer air seal 64, and the second outer air seal 66'. The first outer air seal includes a first array of arcuate segments, as represented by the arcuate segment 65', which circumscribe the first row of rotor blades 58'. Each segment 65' is spaced circumferentially from the adjacent segment leaving a circumferential gap (not shown) therebetween. The second outer air seal includes a second array of arcuate segments, as represented by the arcuate segment 67′, which circumscribe the second row of rotor blades 60′. Each segment 67′ is spaced circumferentially from the adjacent segment leaving a clearance gap (not shown) therebetween. Each of the segments is attached to the outer case by support means, such as the first support means 74′ and the second support means 76′, and is spaced radially from the rotor blades leaving a clearance gap $G_1$ and $G_2$, respectively, therebetween.

A row of stator vanes, as represented by the stator vane 78′, is disposed between the outer air seals. Each stator vane extends inward from the outer case 62′ into proximity with the rotor assembly 56′ leaving a clearance gap $G_3$ therebetween.

The outer case 62′ extends circumferentially about the working medium flow path. The outer case is a pressure vessel for containing the high pressure working medium gases which flow along the working medium flow path. The pressure of the gases in the turbine section may approach several hundred pounds per square inch.

The outer case 62′ has an exterior surface 82, facing radially outward, that is, facing the gases on the interior of the nacelle compartment 20′ and an interior surface 84, facing radially inward. A flow path 86′ for cooling air extends axially through the interior of the engine between the interior surface of the outer case and the outer air seals 64′, 66′ and array of stator vanes 78′. The cooling air flows along the cooling air flow path at a pressure which is higher than the pressure of the working medium flow path. Therefore, the cooling air flows radially inward both through the vanes 78′ (which are hollow) and through gaps in the outer air seal and between the vanes and is discharged into the working medium flow path to protect the outer air seal and the stator vanes against overheating by the hot working medium gases.

The rails 46′, 48′ of the outer case 82′ might each be a single projection which is one piece with a section of the outer case or the rail might be two or more flanges integrally joined one to the other by bolts or the like (see FIGS. 3–5) so that the joined flanges act as a one-piece structure.

The first rail 46′ is located outwardly and is axially aligned with the outer air seal 64′. The rail extends radially outward from the outer surface 82′ of the outer case and has a radial height $h_1$ which is equal to the distance that the rail extends radially outward from the outer surface into the nacelle compartment 20′.

The second rail 48, is spaced axially from the first rail 46′. The second rail is located outwardly of and is axially aligned with the second outer air seal 66′. The second rail extends circumferentially about the outer case and extends radially outward from the outer surface into the nacelle compartment 20′ a distance $h_2$ which is equal to the radial height of the rail.

A rail connector section 88′ of the outer case 62′ extends axially to join the first rail 46′ and the second rail 48′. The rail connector section has an axial length L which is divided into three thirds $L_1$, $L_2$ and $L_3$. In this embodiment, insulation 89, on the interior of the case 62′ extends over the first and central third and most of the last third of the rail connector section.

The shield 50′ is spaced radially by a distance $h_3$ from the exterior surface of the outer case leaving an annular chamber 92′ therebetween. The distance $h_3$ is less than one third of the radial height of the rail to which it is closest (the adjacent rail) over at least seventy percent of the axial length (that is, substantially the entire axial length) of the shield. The shield is formed of a plurality of circumferentially extending tubes 94′, each in flow communication with a source of cooling air such as the fan section 24 (FIG. 1) of the engine through the pipe 54 (FIG. 1). Each tube has a plurality of impingement holes 100′ (shown enlarged for clarity) which place the interior of the tube (the interior passage 98′) in flow communication with the source of cooling air for impinging air on the outer surface 82, of the outer case and on the rails 46′, 48′. An axially extending element, such as the elements 102′, 104′, 106′, extends between each of the tubes and the adjacent tube. Each axially extending element is attached to both of the adjacent tubes to make the shield 50, axially continuous. Each element 102′, 104′, 106′ has a plurality of vent holes (enlarged for clarity) or passages which place the annular chamber in flow communication with the interior of the nacelle compartment. The radially facing vent passages include a first plurality of vent passages 108′ which are spaced circumferentially about the shield, and are radially outward of and axially aligned with the first rail 46′. A second plurality of vent passages 110′ are spaced circumferentially about the shield and are radially outward of and axially aligned with the second rail. And, a third plurality of vent passages 112′ are spaced circumferentially about the shield and are radially outward of and axially aligned with the middle third of the rail connector section.

Figure 3:
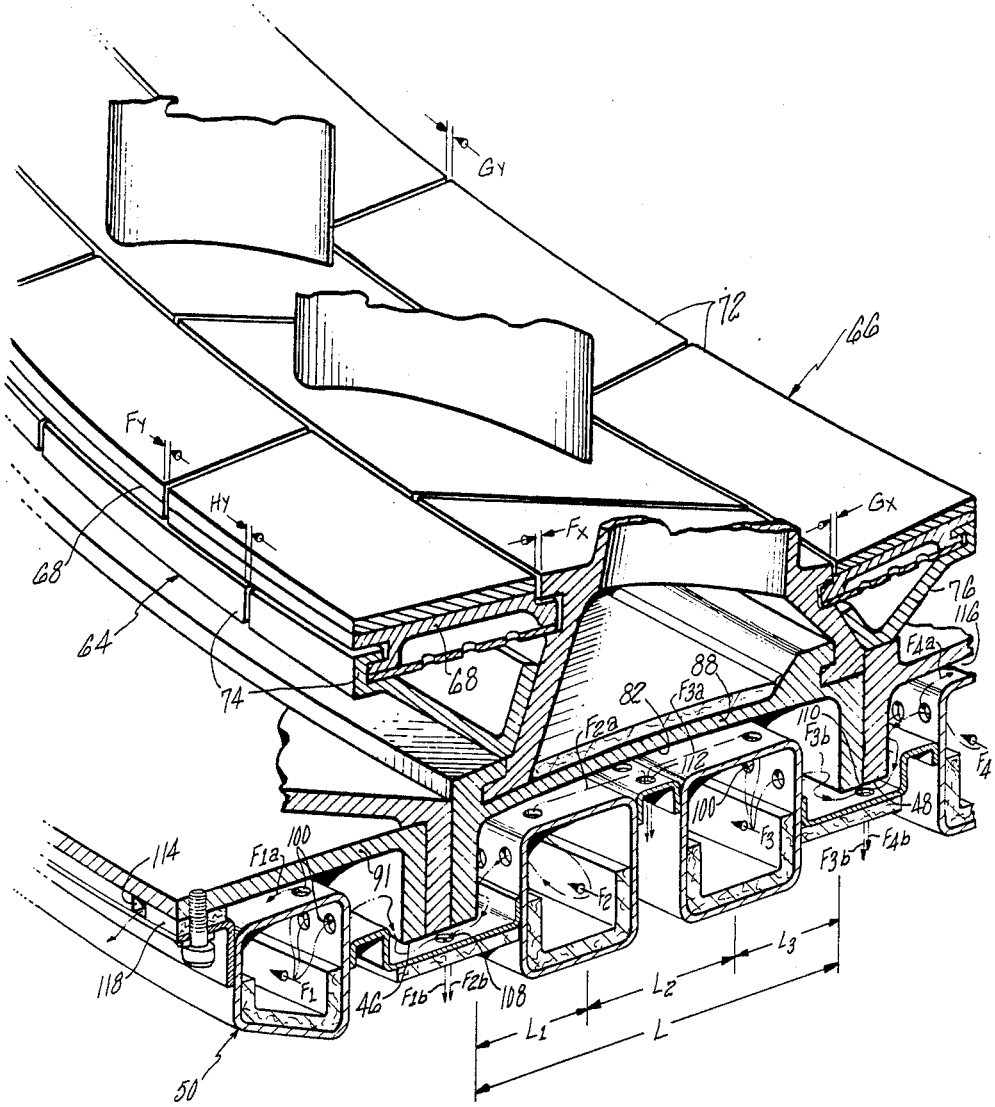
FIG. 3 is a partial perspective view of the portion of the engine shown in FIG. 2.

FIG. 3 is a partial perspective view of a portion of the turbine section shown in the schematic representation in FIG. 2. Elements of FIG. 3 which correspond to elements of FIG. 2 are given the same reference numeral, except the "prime" has been omitted. Each circumferentially slidable support means 74, 76 for an outer air seal and each set of circumferentially slidable air seal segments 68′, 72′ is spaced axially and circumferentially from the adjacent structure. The axial and circumferential gaps accommodate the axial and circumferential movement that occurs as a result of the extraordinary temperature changes of the turbine environment and the radial movement of the outer case. For example, each segment 68′ of the first outer air seal 64 is spaced circumferentially from the adjacent seal segment by a circumferential gap $F_y$ and axially from the adjacent vane segment by an axial gap $F_x$. Each segment 72 of the second outer air seal 66 is spaced circumferentially from the adjacent seal segment by a circumferential gap $G_y$ and axially from the adjacent vane segment by an axial gap $G_x$. The upstream support means 74 and the downstream support means 76 are spaced circumferentially by the gap $H_y$.

The shield 50 is spaced radially from the outer surface 82 of the outer case by a distance which permits the cooling air flowing through the impingement holes 100 to impinge on the rails 46, 48 and on the outer case sections 88, 91 adjacent to the rails. A flow path for cooling air extends circumferentially in each of the tubes as shown by the flow paths $F_1$, $F_2$, $F_3$, and $F_4$. The impingement flow out of each tube, after impingement, splits in two different directions along the flow paths designated by the additional subscripts a and b, respectively. The relative percentage of flow going to the adjacent vent passages 108, 110, 112 from each impingement hole depends on the location of the impingement hole with respect to the vent passages. This allows a great deal of flexibility in providing convective cooling and tailoring the cooling after installation by adding or blocking the vent passages. For example, there are three sets of vent passages which extend in the radial direction and two sets of the vent passages 114, 116 which extend axially between the insulation standoffs 118 from the outer case.

Figure 4:
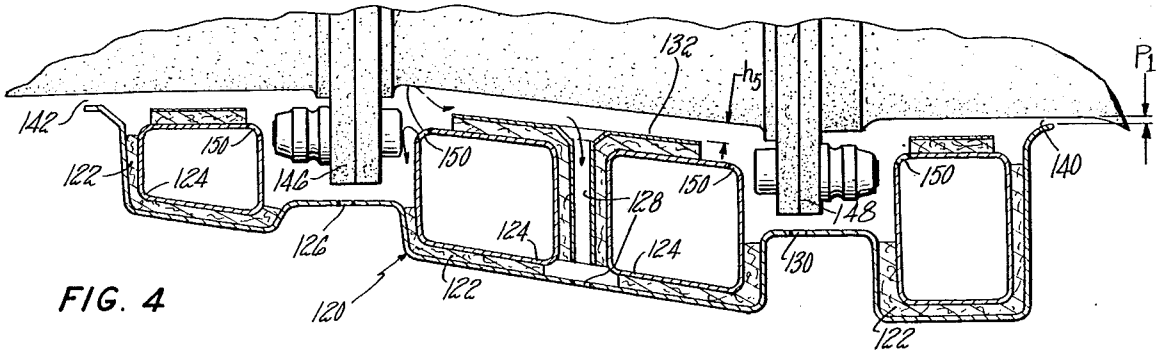
FIG. 4 is an alternate embodiment of the shield shown in FIG. 3.

FIG. 4 is an alternate embodiment of the shield 90 shown in FIG. 3 and is designated by the reference numeral 120. The insulating material 122 is disposed between the shield and cooling air tubes 124. The vent passage 128 is also insulated from the cooling air tubes. The annular chamber 132 formed by this shield again has a radial height $h_5$ which is less than one third the radial height of the adjacent rail 146 or 148 extending circumferentially about the outer case to promote impingement cooling of the case. A circumferentially extending exhaust passage 140 faces in the axial downstream direction and a circumferentially extending passage 142 faces in the axial upstream direction by reason of the shell end being spaced radially from the outer case by a distance $P_1$. The distance $P_1$ in one embodiment was approximately fifty mils or less and the impingement holes 150 about 60 mils.

Alternatively, the shield could be formed by a tightly woven fiberglass blanket extending outwardly of the cooling air tubes with the cooling air tubes each insulated from the adjacent structure. It is not believed that such a shield is as effective as the other embodiments which duct the cooling air after use to preferred locations.

FIG. 5 is an alternate embodiment of the construction shown in FIG. 2 and FIG. 3 and is an enlarged view of the embodiment shown in FIG. 1. In this particular construction, the shield 50 defines a manifold which surrounds and therefore insulates the rails 46, 48 and the outer case 62 from hot gases in the compartment 20. The manifold has an inner shell 156 and an outer shell 158 defining the cooling air passage 52 therebetween extending circumferentially about the engine. A plurality of local vent tubes 138 are axially aligned with the rails and the middle third section of the case 62 extending between the rails. Insulation 152 is provided to the interior of the manifold to shield the cooling air passage from heat transfer from the interior of the nacelle and from heat transfer from the outer case to the cooling air both by radiation and convection from the cooling air which has impinged against the outer case.

Figure 6:
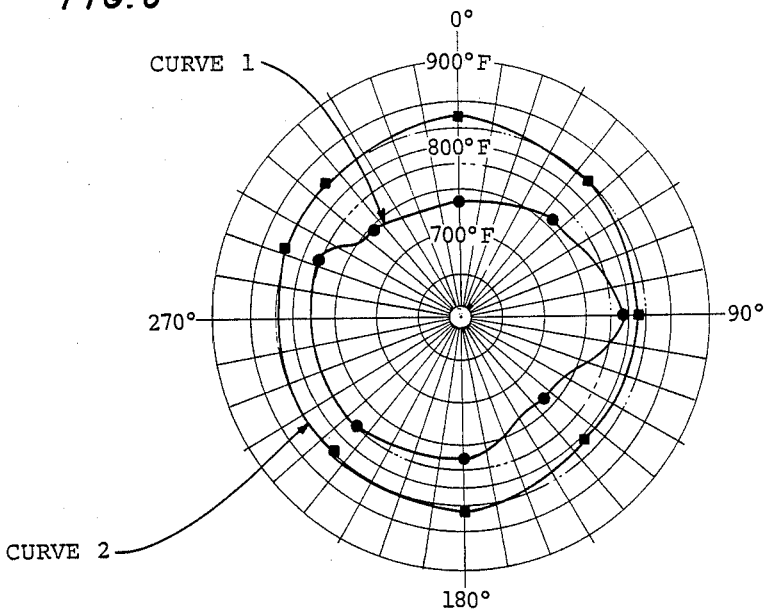
FIG. 6 is a graphical representation of the temperature distribution in a flange with cooling air not being impinged on the outer case showing the effect of insulation and shielding.
Figure 7:
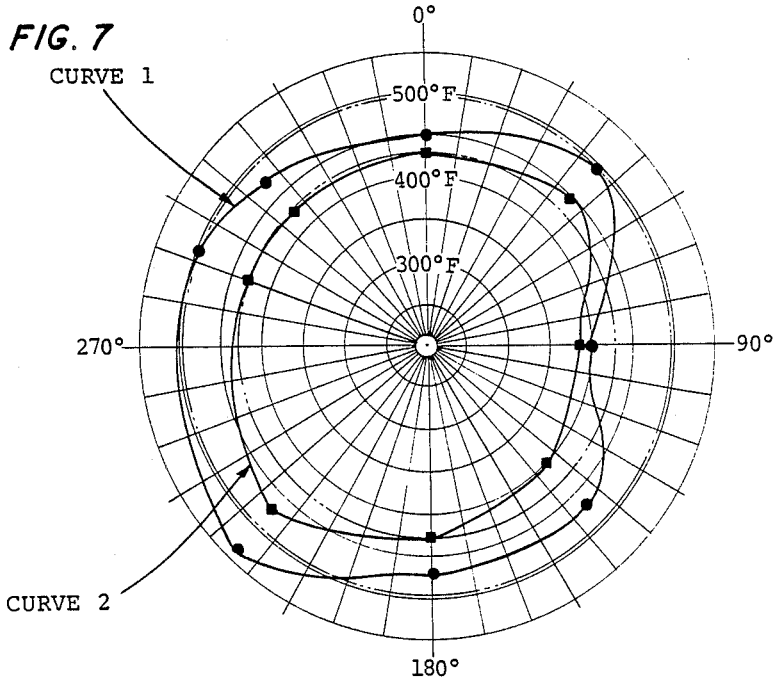
FIG. 7 is a graphical representation of the temperature distribution in a flange with cooling air not being impinged on the outer case.

FIG. 6 and 7 are graphical representations of the temperature in the rail of an outer case about the circumference of the case. These results show the effectiveness of the concept of shielding using an actual turbofan gas turbine engine under test conditions. In FIG. 6, the cooling air flow was turned off for both polar curves. In FIG. 7, the cooling air flow was on for both polar curves. Curve 1 in each of FIGS. 6 and 7 shows the temperature that resulted from using uninsulated cooling air tubes and no shield. Curve 2 in each of FIGS. 6 and 7 shows the temperatures that resulted from using insulated cooling air tubes with the shield installed in accordance with the embodiment of the invention described in FIG. 4. The shield was made from fiberglass.

With reference to FIGS. 1 and 2, during operation of the high by pass turbofan gas turbine engine, hot working medium gases are flowed from the combustion section 28 to the turbine section 30. The hot, pressurized gases are expanded in the turbine section. As the gases are flowed along the annular flow path 32, heat is transferred from the gases to components in the turbine section. The arrays of turbine rotor blades 58, 60 are bathed in the hot working medium gases and respond more quickly than does the outer case 62, which is more remote from the working medium flow path. An initial clearance is provided to accommodate the rapid expansion of the blades and the disks with respect to the case and the structure supported by the case, such as the outer air seals and the stator vanes. As a result, the radial gaps $G_1$, $G_2$, and $G_3$ between the rotor assembly and the stator assembly vary. As time passes, the outer case receives heat from the gases and expands away from the rotor blades increasing the size of the gaps $G_1$, $G_2$, and $G_3$.

The size of these gaps is regulated by impinging cooling air on the coolable rails 46', 48' and by cooling the rail connector section 88'. As the rails contract, the rails force the first axial location $A_1$ and the second axial location $A_2$ of the outer case 62, to move inwardly causing the first support means 74' and the second support means 76' to decrease in diameter moving the arcuate seal segments and the ends of the stator vanes to a smaller diameter. This movement decreases the size of the gaps $G_1$, $G_2$ and $G_3$.

In addition to the air flowed axially to the interior of the engine and the cooling air flowed in the path 86' along the interior of the outer case to cool the outer case, pressurized air flows along the secondary flow path 38 and over the core nacelle 18. Because the air is pressurized and because the air on the interior of the nacelle compartment 20 is at nearly ambient pressure, the large sealing areas which result from the large nacelles of high bypass turbofans permit a small amount of leakage of the fan bypass air at high pressures into the interior of the nacelle. This flow of cooling air, which can occur in any region between nacelle parts because seals are not completely air tight or where seals have deteriorated with age of the structure, can introduce cold spots into the interior of the nacelle. In addition, accessory equipment disposed in the large core nacelle compartment may locally discharge hot gases or heat the gases within the compartment causing local hot spots in the core compartment. These hot spots and cold spots cause circumferential gradients in the outer case and particularly in rails which extend circumferentially about the outer case where they function as heat transfer fins.

For example, as shown in FIG. 6, if there is no shield and the cooling air is off, the case runs at a cooler temperature which has gradients in the circumferential direction as shown by the nonsymetrical temperature plot of curve 1. As will be appreciated there is a severe circumferential thermal gradient in comparison to the insulated, shielded construction (curve 2). The insulated, shielded construction has rail temperatures which are elevated by fifty to a hundred degrees. But the rail does not have the same thermal stresses by reason of the temperature gradient in the circumferential direction. This reduces stresses and, more importantly, for outer air seals which are positioned by the outer case as a function of outer case temperature, makes more uniform the concentricity of the outer air seal than if the shield were not employed. Moreover, the rails are at a higher temperature in curve 2 under operating conditions (no cooling air flow) which correspond to high power settings of the engine, such as at Sea Level Take Off. At this operating condition, the temperature of the gas path is very high. By reason of the higher rail temperature, the radial temperature gradient in the rail is decreased, which has a very significant impact on the fatigue life of the rail. Venting the annular chamber ensures the temperature of the rail does not increase to a level which would adversely affect the radial clearance gaps $G_1$, $G_2$, $G_3$.

This reduction in the circumferential temperature gradient from shielding occurs even as cooling air is impinged on the outer case as shown in FIG. 7. Again, curve 2 represents the circumferential distribution of temperatures using insulated pipes and a shield extending between the pipes to diminish the transfer of heat resulting from temperature gradients within the nacelle compartment. Curve 1 of FIG. 7 shows that the rail temperature distribution with no shielding and no insulation is less symmetrical. This causes a decrease in the concentricity of the outer air seal for the unshielded, uninsulated construction.

Two other advantages occur as a result of using a shield in connection with the impingement of cooling air on the outer case. First, the uniform higher temperature in the flange which results when the cooling air is turned off increases the difference in temperature between the flange and the cooling air and provides for increased heat transfer from the flange to the low temperature cooling air. Moreover, a greater change in temperature results from turning the cooling air on. This increases the amount of force which can be exerted by the rails for a given amount of cooling air. Thus, the use of the shields increases the effectiveness of the cooling air by causing a greater temperature reduction in the case for an incremental expenditure of cooling air which is discharged against the case. Because the cooling air is pressurized as a result of work done by the engine, this increases the efficiency of the engine.

Secondly, the shield acts as a flow duct ducting the cooling air so that it is used twice, once for impingement cooling and again for convective cooling of the rail connector section of the case and for convective cooling of the rail as the air flows along the rail and over the outwardly facing surface of the rail. For example, referring to FIG. 3 the cooling air from flow path $F_1$ flows axially along the surface of the outer case on cooling path $F_{1a}$ and radially and circumferentially along the flange as it moves to the vent hole along cooling path $F_{1b}$. Flow along the rail is repeated for flow paths $F_{2b}$, $F_{3b}$, and $F_{4b}$. Flow along the case is repeated for flow paths $F_{2a}$, $F_{3a}$, and $F_{4a}$. Thus, for a given amount of cooling air, a larger change in the radial location of the outer case will occur and a greater change in the clearance gaps $G_1$, $G_2$, $G_3$ with a concomitant increase in engine efficiency. The shield also reduces thermal distortion of the concentricity of the case allowing tighter clearances between the outer air seal and the whirling rotor blades. As mentioned earlier, the shield also reduces case stresses by reducing thermal gradients in the circumferential direction under all operating conditions and in the radial direction at ea Level Take Off when the cooling air is turned off.

Although the invention has been shown and described with respect to detailed embodiments thereof, it should be understood by those skilled in the art that various changes in form and detail thereof may be made without departing from the spirit and the scope of the claimed invention.

We claim:

1. For a high bypass turbofan gas turbine engine of the type which is disposed in a nacelle compartment, the turbofan engine having an annular flow path for working medium gases, a rotor assembly which includes rows of rotor blades extending outwardly across the working medium flow path and a stator assembly which includes an outer case and seal structure disposed about the rotor blades, the seal structure including a first outer air seal which is attached to the outer case and which circumscribes a row of rotor blades, and a second outer air seal which is attached to the outer case and which circumscribes another row of rotor blades, a stator assembly which comprises:

an outer case which extends circumferentially about the working medium flow path, the outer case having an interior surface bounding a flow path for cooling air in flow communication with the working medium flow path, an exterior surface facing the interior of the nacelle compartment, a first rail and a second rail spaced axially from the first rail, the rails extending circumferentially about the outer case, extending radially outward from the outer surface of the outer case into the nacelle compartment, and being located radially outward of at least one of the outer air seals, and, a rail connector section of the outer case which extends axially to join the first rail and the second rail; and, a shield disposed in the nacelle compartment which is spaced radially from the outer case leaving an annular chamber therebetween which is in flow communication with the nacelle compartment, the shield extending axially beyond the rails and over the rail connector section to reduce circumferential temperature gradients in the rails and in the case by shielding the rails and the rail connector section from temperature gradients within the nacelle.

2. The stator assembly of claim 1 in which the shield includes a layer of insulating material which is adapted to be disposed between the annular chamber and the nacelle compartment.

3. The stator assembly of claim 2 which further includes a plurality of circumferentially spaced brackets which attach the shield to the outer case.

4. The stator assembly of claim 3 in which a layer of insulating material is disposed between the bracket and the shield to block the flow of heat from the outer case to the shield.

5. The stator assembly of claim 1 which further includes means for flowing cooling air into the annular chamber and against the coolable rails and wherein the shield extends outwardly of the means for flowing cooling fluid into the annular chamber for shielding the means for flowing cooling fluid from the interior of the nacelle compartment.

6. The stator assembly of claim 1 in which the shield has at least one passage in flow communication with a source of cooling fluid, holes for flowing impingement fluid from each passage against the rails and local vent passages which are located to cause the cooling fluid after impingement to flow along the outer surface of the rail connector section and the cooling fluid to flow circumferentially along the rail and radially outward and across the outwardly facing surface of the rail.

7. The stator assembly of claim 6 wherein a first plurality of vent passages are spaced circumferentially about the shield and are radially outward of and axially aligned with the first rail, wherein a second plurality of vent passages are spaced circumferentially about the shield and are radially outward of and axially aligned with the second rail, and wherein a third plurality of vent passages are spaced circumferentially about the shield and are radially outward of and axially aligned with the middle third of the connecting case element.

8. The stator assembly of claim 7 wherein the shield is formed of a plurality of circumferentially extending tubes, each in flow communication with a source of cooling air and wherein an axially extending element extends between each of said tubes and the adjacent tube and is attached to both of said tubes.

9. The stator assembly of claim 8 wherein said vent passages are disposed in said axially extending elements.

10. The stator assembly of claim 7 wherein the shield is formed of a manifold having an inner shell and an outer shell, the inner shell having impingement holes adjacent each rail and having vent tubes which extend from the inner shell to the outer shell, each vent tube bounding a passage for venting cooling air to the nacelle compartment.

11. The stator assembly of claim 6 wherein each passage for cooling air within the shield is insulated against heat transfer from the nacelle compartment and from the gases in the annular chamber between the shield and the outer case.

12. The stator assembly of claim 6 wherein the shield is spaced from the outer case by a distance which is less than one-third the radial height of the rail over substantially the entire axial length of the shield.

13. The stator assembly of claim 12 wherein the outer case has a layer of insulating material extending circumferentially about the interior of the outer case which is axially aligned with the rail connector section of the case.

14. For a high bypass turbofan, gas turbine engine of the type disposed in a nacelle compartment, the engine having an annular flow path for working medium gases extending axially through the engine, the engine having a rotor assembly which include a first row and a second row of rotor blades extending outwardly across the working medium flow path and the engine having a stator assembly extending axially through the engine, the stator assembly including an outer case, including a first outer air seal formed of a first array of arcuate segments which circumscribes the first row of rotor blades, each segment being spaced circumferentially from the adjacent segment leaving a clearance gap therebetween, and including a second outer air seal formed of a second array of arcuate segments which circumscribes the second row of rotor blades, each segment being spaced circumferentially from the adjacent segment leaving a clearance gap therebetween, each of the segments being attached to the outer case, a stator assembly which includes a clearance control system comprising:

an outer case which extends circumferentially about the working medium flow path, the outer case having an interior surface bounding a flow path for cooling air in flow communication with the working medium flow path, an exterior surface facing the interior of the nacelle compartment, a first rail and a second rail spaced axially from the first rail, the rails extending circumferentially about the outer case, extending radially outward from the outer surface into the nacelle compartment, and being located outwardly of at least one of the outer air seals, and, a rail connector section of the outer case which extends axially to join the first rail and the second rail; and, a shield disposed in the nacelle compartment which is spaced radially from the outer case by a radial distance which is less than or equal to one-third the radial height of the adjacent rail leaving an annular chamber therebetween which is in flow communication with the nacelle compartment, the shield extending axially beyond the rails and over the rail connector section, the shield including means in flow communication with a source of cooling air, for flowing cooling air circumferentially about the engine and for discharging the cooling air into the annular chamber and against the coolable rails, a first plurality of vent passages spaced circumferentially about the shield, and radially outward of and axially aligned with the first rail, a second plurality of vent passages spaced circumferentially about the shield and radially outward of and axially aligned with the second rail, a third plurality of vent passages spaced circumferentially about the shield and radially outward of and axially aligned with the middle third of the rail connector section, a layer of insulating material disposed between the annular chamber and the nacelle compartment, wherein the annular chamber and shield block the transfer of heat between the outer case and the interior of the nacelle compartment under all operating conditions of the engine and wherein the shield blocks the transfer of heat from the interior of the compartment to the cooling air in the shield, and wherein the annular chamber collects the cooling air and ducts the cooling air via the flow paths along and over the rails and along the rail connector section of the case prior to venting the cooling air to the nacelle compartment to provide cooling to the outer case.

15. The clearance control system of claim 14 wherein the shield is a manifold having an inner wall and impingement holes for discharging cooling air against the rails, an outer wall spaced radially outward from the inner wall leaving a cooling air passage therebetween and a layer of insulation attached to the outer wall to block the flow of heat from the nacelle compartment to the cooling air and to the outer case and wherein vent tubes extend radially from the inner wall to the outer wall to place the annular chamber in flow communication with the nacelle compartment.

16. The clearance control system of claim 15 wherein the shield includes a plurality of circumferentially extending tubes, each in flow communication with a source of cooling air and wherein an axially extending element extends between each of said tubes and the adjacent tube and is attached to both of said tubes.

17. The stator assembly of claim 16 wherein said vent passages are disposed in said axially extending elements.

18. The stator assembly of claim 14 wherein the shield extends outwardly of the means for flowing cooling air into the annular chamber for shielding the means for flowing cooling air from the interior of the nacelle compartment.

* * * * *